US010189170B2

(12) United States Patent
Marfione et al.

(10) Patent No.: US 10,189,170 B2
(45) Date of Patent: Jan. 29, 2019

(54) LOCKING FOLDING KNIFE

(71) Applicant: Microtech Knives, Inc., Bradford, PA (US)

(72) Inventors: Anthony L. Marfione, Fletcher, NC (US); A. Mark Mandeville, Fletcher, NC (US)

( * ) Notice: Subject to any disclaimer, the term of this patent is extended or adjusted under 35 U.S.C. 154(b) by 70 days.

(21) Appl. No.: 15/218,554

(22) Filed: Jul. 25, 2016

(65) Prior Publication Data

US 2018/0021962 A1 Jan. 25, 2018

(51) Int. Cl.
*B26B 1/04* (2006.01)

(52) U.S. Cl.
CPC ..... *B26B 1/044* (2013.01)

(58) Field of Classification Search
CPC ..... B26B 1/044
See application file for complete search history.

(56) References Cited

U.S. PATENT DOCUMENTS

| | | | | |
|---|---|---|---|---|
| 6,101,724 | A * | 8/2000 | Halligan | B26B 1/046 30/155 |
| 8,028,419 | B2 * | 10/2011 | VanHoy | B26B 1/044 30/155 |
| 2007/0204468 | A1 * | 9/2007 | Cheng | B26B 1/044 30/160 |
| 2012/0180320 | A1 * | 7/2012 | Lo | B26B 1/044 30/161 |
| 2015/0367520 | A1 * | 12/2015 | MacNair | B26B 1/044 30/161 |

* cited by examiner

*Primary Examiner* — Stephen Choi
(74) *Attorney, Agent, or Firm* — Steve LeBlanc LLC.

(57) ABSTRACT

A locking folding knife includes a handle and a blade pivotally connected to the handle. The blade has a cutting edge and a first position in which at least a portion of the cutting edge is located within the handle and a second position in which a majority of the cutting edge is outside of the handle. A pocket is defined in a first surface of the handle. A through-cut is in the pocket, wherein the through-cut terminates in the pocket at an endpoint. A lock is integral with the handle and extends from the endpoint of the through-cut, wherein the lock engages with a portion of the blade in the second position.

14 Claims, 3 Drawing Sheets

LOCKING FOLDING KNIFE

FIELD OF THE INVENTION

The present invention generally involves a locking folding knife.

BACKGROUND OF THE INVENTION

Locking folding knives are well-known in the art and identify a class of folding knives having a blade pivotally connected to a handle and a lock that secures the blade in an open position. In a closed position, a cutting edge of the blade resides within the handle, and the handle protects the cutting edge from inadvertent contact that might damage the cutting edge or cause personal injury. To transition to an open position, the blade pivots with respect to the handle to expose the cutting edge, and the lock engages to hold the blade in the open position.

Many different lock designs exist to allow the lock to reliably and consistently function over the course of thousands of cycles and decades of use, and the different lock designs often involve a balancing of competing goals within limits imposed by aesthetics and materials. Several existing designs use a lock bar which is an integral part of the knife handle. Optimal reliability and longevity/service life of an integral lock bar is dependent upon the length of the lock bar and the interrelationship of the interface of the locking surface and the deflection axis of the lock bar. A longer lock bar requires less angle of deflection which tends to reduce the tendency for fatigue, but also complicates and limits the objective of optimum geometry as between the deflection axis and the lock surface axis while preserving desirable aesthetics.

The need exists for an improved locking folding knife that may overcome one or more disadvantages of existing integral lock bar designs. For example, an improved design may permit a lengthened lock bar and allow for optimum placement of the deflection axis in handles which present geometric challenges such as handles which fit the natural curve of the hand.

BRIEF DESCRIPTION OF THE INVENTION

Aspects and advantages of the invention are set forth below in the following description, or may be obvious from the description, or may be learned through practice of the invention.

One embodiment of the present invention is a locking folding knife having a handle and a blade pivotally connected to the handle. The blade has a cutting edge and a first position in which at least a portion of the cutting edge is located within the handle and a second position in which a majority of the cutting edge is outside of the handle. A pocket is defined in a first surface of the handle. A through-cut is in the pocket, wherein the through-cut terminates in the pocket at an endpoint. A lock is integral with the handle and extends from the endpoint of the through-cut, wherein the lock engages with a portion of the blade in the second position.

In another embodiment of the present invention, a locking folding knife includes a first scale and a second scale opposed to the first scale. A blade is pivotally connected between the first and second scales, wherein the blade has a closed position and an open position. A pocket is defined in a first surface of the first scale, and a through-cut is in the pocket, wherein the through-cut terminates in the pocket at an endpoint. An integral extension of said first scale extends from the endpoint of the through-cut, wherein the integral extension engages with a portion of the blade in the open position.

Another embodiment of the present invention is a locking folding knife that includes a handle and a blade pivotally connected to the handle, wherein the blade has a tang at one end. A pocket is defined in an outer surface of the handle, and an integral extension of the handle begins in the pocket and extends from the pocket along the outer surface of the handle. The integral extension of the handle engages with the tang of the blade when the blade is pivotally rotated with respect to the handle.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
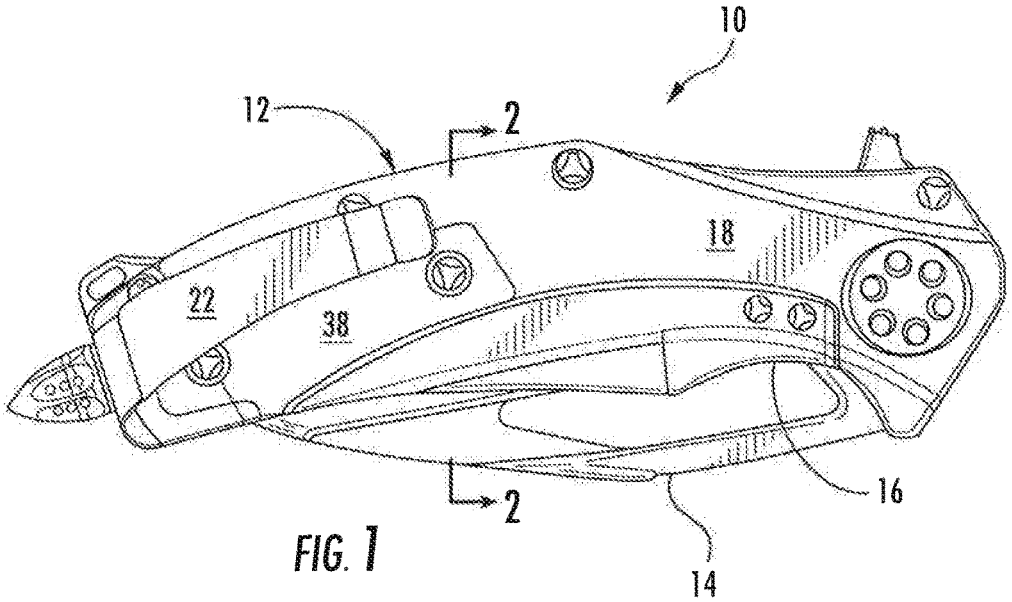
FIG. 1 is a plan view of a locking folding knife according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. As used herein, the term "outer" refers to a surface that is readily visible on the outside of an assembled knife, whereas the term "inner" refers to a surface that is generally not visible and is on the inside of an assembled knife.

Each example is provided by way of explanation of the invention, not limitation of the invention. In fact, it will be apparent to those skilled in the art that modifications and variations can be made to embodiments of the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
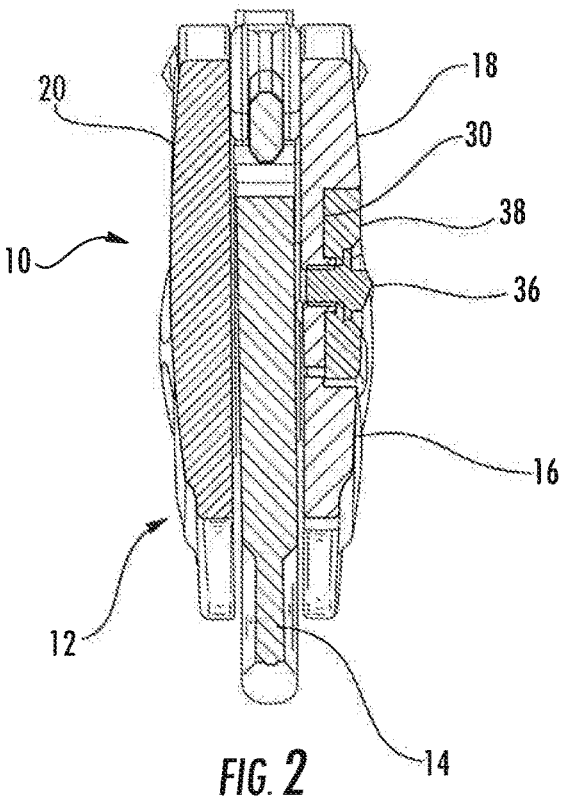
FIG. 2 is a cross-section view of the locking folding knife shown in FIG. 1 taken along line 2-2.
Figure 3:
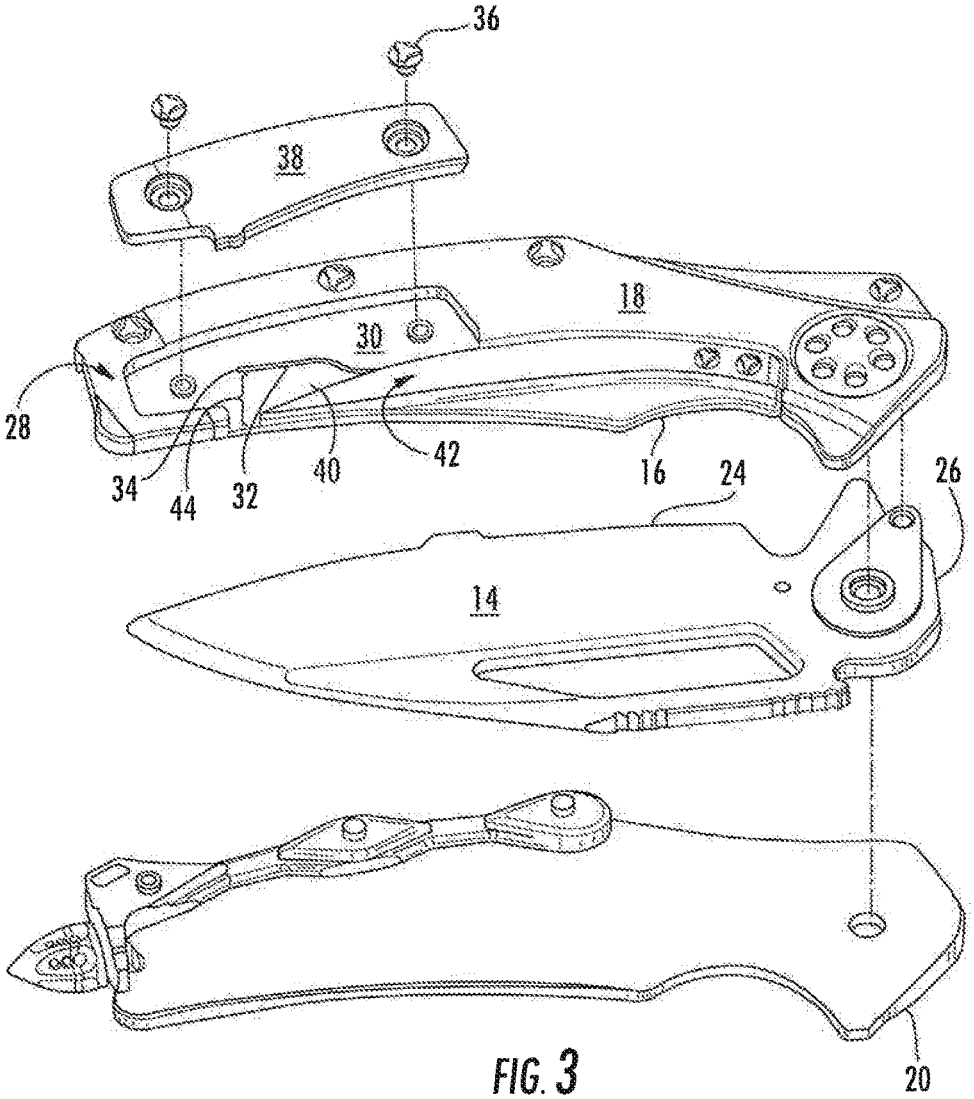
FIG. 3 is an exploded view of the locking folding knife shown in FIG. 1 in the closed position.
Figure 4:
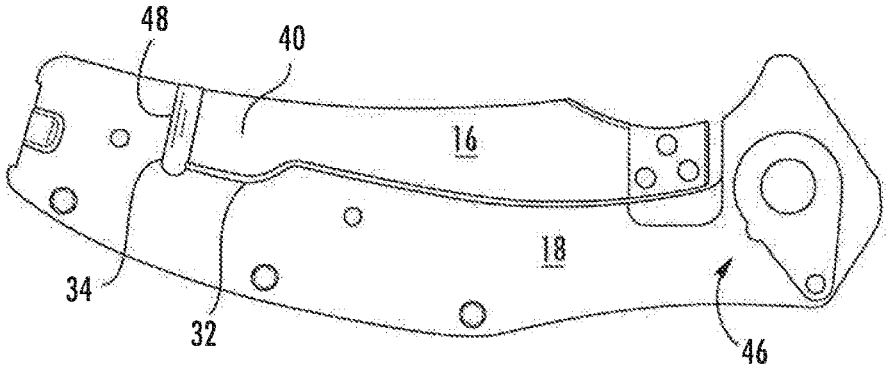
FIG. 4 is a plan view of the inner surface of the upper scale shown in FIG. 3.
Figure 5:
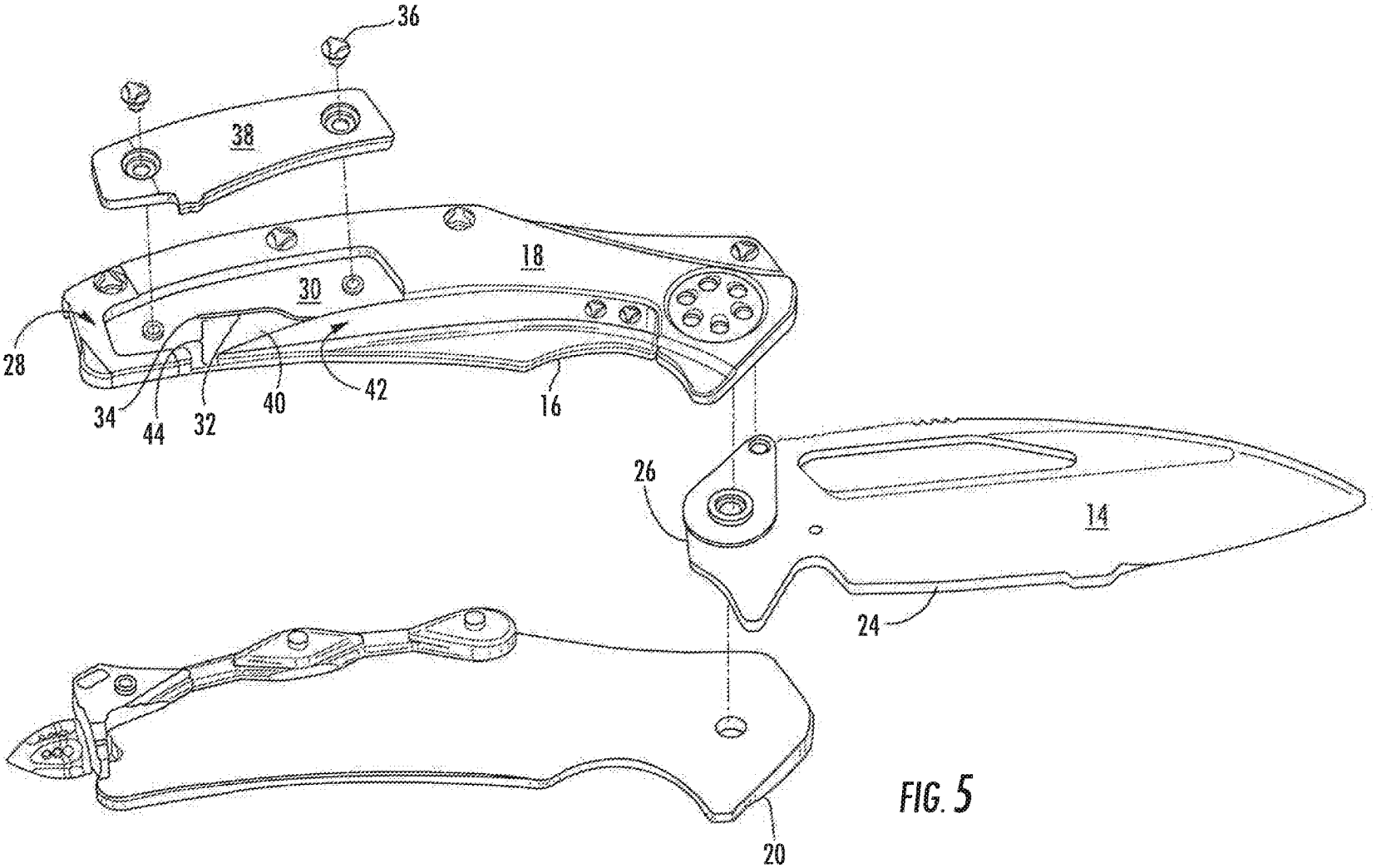
FIG. 5 is an exploded view of the locking folding knife shown in FIG. 1 in the open position.

Embodiments of the present invention include a locking folding knife 10 as shown in FIGS. 1-5. The primary components of the knife 10 are a handle 12, a blade 14, and a lock 16. Together, these components allow the knife 10 or blade 14 to have a first or closed position in which at least a portion of the blade 14 resides in the handle 12, as shown in FIGS. 1-3, and a second or open position in which the blade 14 extends from the handle 12, and the lock 16 engages with a portion of the blade 14 to hold the knife 10 or blade 14 in the open position, as shown in FIG. 5.

The handle 12 provides the general structure for attaching the various components of the knife 10 and shielding the blade 14 from inadvertent contact when in the closed position. The handle 12 may be constructed from wood, plastic, carbon fiber, aluminum, steel, or any other suitable material having the desired strength, weight, and wear characteristics. The handle 12 may be an integral component constructed from a single piece, or as shown most clearly in FIGS. 2 and 3, the handle 12 may be constructed from opposing, spaced-apart scales 18, 20 connected together to create an internal cavity in which the blade 14 may reside when in the closed position. A clip 22 may be attached to the handle 12 at various locations to facilitate secure storage of the knife 10 in a pocket.

The blade 14 generally includes a cutting edge 24 on one surface and a tang 26 on another surface. As shown in FIGS. 3 and 5, the blade 14 is pivotally connected to the handle 12 between the scales 18, 20 so the blade 14 may pivot with respect to the handle 14 to transition from the closed position to the open position. In the closed position, at least a portion of the cutting edge 24 is located within the handle 12 to protect the cutting edge from inadvertent damage or contact, as shown in FIG. 3. The blade 14 may thus pivot out of the handle 12 so that a majority of the cutting edge 24 is outside of the handle 12 in the open position, as shown in FIG. 5.

As shown most clearly in the exploded views of FIGS. 3 and 5, an outer surface 28 of the handle 12 or upper scale 18 defines a pocket 30, cavity, or indention. A through-cut 32 completely through the upper scale 18 extends through the pocket 30 and terminates in the pocket 30 at an endpoint 34. When assembled, a screw or other fastener 36 may attach an insert 38 to the handle 12 or upper scale 18 to cover the through-cut 32 in the pocket 30. In this manner, the insert 38 may conceal the pocket 30 and through-cut 32 to enhance the overall appearance of the knife 10.

As shown most clearly in FIGS. 3-5, an integral extension 40 of the handle 12 or upper scale 18 may begin at the endpoint 34 of the through-cut 32 and extend along the outer surface 28 of the handle 12 or upper scale 18 so that a surface 42 of the integral extension 40 is flush with the upper surface 28 of the handle 12 or upper scale 18. In this manner, the integral extension 40 forms the lock 16 as a continuous, integral piece of the handle 12 or upper scale 18. The integral extension 40 or lock 16 may be biased to engage with a portion of the blade 14 in the open position to securely hold the blade 14 in place with respect to the handle 12. For example, as shown most clearly in FIG. 5, the integral extension 40 or lock 16 may engage with the tang 26 of the blade 14 when the blade 14 is pivotally rotated with respect to the handle 12. To close the knife 10 or blade 14, the integral extension 40 or lock 16 is pushed upward as shown in FIG. 5 to overcome the bias and separate the integral extension 40 or lock 16 from the tang 26 of the blade 14, thereby allowing the blade 14 to be rotated with respect to the handle 12.

The width and thickness of the integral extension 40 or lock 16 may be selected to achieve a desired stiffness or flexibility of the integral extension 40 or lock 16. For example, in particular embodiments the through-cut 32 may be a straight cut through the pocket 30 so that the integral extension 40 or lock 16 has a constant width 44 in the pocket 30. Alternately, as shown in FIGS. 3-5, the through-cut 32 may be curved or angled to define an increasing or varying width 44 of the integral extension 40 or lock 16 in the pocket 30. In general, a larger width 44 of the integral extension 40 or lock 16 in the pocket 30 results in a correspondingly stiffer integral extension 40 or lock 16. Similarly, as shown most clearly in FIGS. 3 and 5, the integral extension 40 or lock 16 may be thinner in the pocket 30 than outside of the pocket 30.

FIG. 4 provides a plan view of an inner surface 46 the upper scale 18 shown in FIG. 3. As shown in FIG. 4, a groove 48 defined in the inner surface 46 of the handle 12 or upper scale 18 may intersect the through-cut 32 at the endpoint 34. The groove 48 further reduces the thickness of the handle 12 or upper scale 18 at the beginning of the integral extension 40 to establish a deflection axis that facilitates bending the integral extension 40 or lock 16 with respect to the handle 12 or upper scale 18. In particular embodiments, the inner surface 46 of the handle 12 or upper scale 18 may include two or more parallel grooves to distribute deflection stresses over a wider area.

The insert 38 attached to the pocket 30 may also provide additional stiffening to the integral extension 40. For example, as shown most clearly in FIG. 1, the insert 38 may cover the integral extension 40 in the pocket 30 to prevent or resist upward movement of the integral extension 40 away from the blade 14 or tang 26.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A locking folding knife, comprising:

a handle;

a blade pivotally connected to said handle, wherein said blade has a cutting edge and a first position in which at least a portion of said cutting edge is located within said handle and a second position in which a majority of said cutting edge is outside of said handle;

a pocket defined in a first surface of said handle;

a through-cut in said pocket, wherein said through-cut terminates in said pocket at an endpoint; and a lock integral with said handle and extending from said endpoint of said through-cut, wherein said lock engages with a portion of said blade in said second position.

2. The locking folding knife of claim 1, further comprising an insert attached to said handle and covering said through-cut in said pocket.

3. The locking folding knife of claim 1, wherein said through-cut defines a varying width of said lock in said pocket.

4. The locking folding knife of claim 1, wherein said lock has a first thickness in said pocket and a second thickness outside of said pocket, and said first thickness is less than said second thickness.

5. The locking folding knife of claim 1, wherein said lock extends adjacent to said handle so that a surface of said lock is flush with said first surface of said handle.

6. The locking folding knife of claim 1, further comprising a groove defined in a second surface of said handle and said groove intersects said through-cut.

7. The locking folding knife of claim 6, wherein said groove intersects said through-cut at said endpoint.

8. A locking folding knife, comprising:

a first scale and a second scale opposed to said first scale;

a blade pivotally connected between said first and second scales, wherein said blade has a closed position and an open position;

a pocket defined in a first surface of said first scale;

a through-cut in said pocket, wherein said through-cut terminates in said pocket at an endpoint; and an integral extension of said first scale extends from said endpoint of said through-cut, wherein said integral extension engages with a portion of said blade in said open position.

9. The locking folding knife of claim 8, further comprising an insert attached to said first scale and covering said through-cut in said pocket.

10. The locking folding knife of claim 8, wherein said through-cut defines a varying width of said integral extension in said pocket.

11. The locking folding knife of claim 8, wherein said integral extension has a first thickness in said pocket and a second thickness outside of said pocket, and said first thickness is less than said second thickness.

12. The locking folding knife of claim 8, wherein said integral extension extends adjacent to said first scale so that a surface of said integral extension is flush with said first surface of said first scale.

13. The locking folding knife of claim 8, further comprising a groove defined in a second surface of said first scale and said groove intersects said through-cut.

14. The locking folding knife of claim 13, wherein said groove intersects said through-cut at said endpoint.

* * * * *